US012258829B1

(12) United States Patent
Nguyen

(10) Patent No.: US 12,258,829 B1
(45) Date of Patent: Mar. 25, 2025

(54) SLIP SUBSYSTEM, METHOD AND SYSTEM

(71) Applicant: Baker Hughes Oilfield Operations LLC, Houston, TX (US)

(72) Inventor: Tuan Nguyen, Pearland, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/470,679

(22) Filed: Sep. 20, 2023

(51) Int. Cl.
*E21B 23/01* (2006.01)
*E21B 23/04* (2006.01)

(52) U.S. Cl.
CPC ..... *E21B 23/01* (2013.01); *E21B 23/04115* (2020.05)

(58) Field of Classification Search
CPC .. E21B 23/04115; E21B 7/04; E21B 33/1265; E21B 33/129; E21B 23/01
See application file for complete search history.

(56) References Cited

U.S. PATENT DOCUMENTS

| | | | | |
|---|---|---|---|---|
| 2,920,703 A * | 1/1960 | Rodgers | E21B 43/10 166/217 |
| 3,045,758 A * | 7/1962 | Muse | E21B 23/01 166/216 |
| 2015/0021012 A1* | 1/2015 | Gerrard | E21B 23/01 166/237 |
| 2017/0044859 A1* | 2/2017 | Blair | E21B 23/06 |
| 2019/0257164 A1* | 8/2019 | Tom | E21B 23/01 |

* cited by examiner

*Primary Examiner* — Brad Harcourt
(74) *Attorney, Agent, or Firm* — Baker Hughes Company

(57) ABSTRACT

A slip subsystem, including a slip having wickers angled in a first direction and wickers angled in a second direction opposite the first direction, an engager disposed adjacent the slip to selectively engage the wickers, and a biaser to bias the engager into engagement with the wickers. An anchor including a housing having a slip ramp, a drive plate, a power spring to bias the drive plate, a slip subsystem operably connected with the housing. A method for setting an anchor in a borehole, including driving a drive plate into a slip, forcing the slip to climb a housing, engaging an activation block with the slip to prevent slip movement relative to the housing in an anti-setting direction. A borehole system, including a borehole in a subsurface formation, a string in the borehole, and a slip subsystem disposed within or as a part of the string.

16 Claims, 9 Drawing Sheets

SLIP SUBSYSTEM, METHOD AND SYSTEM

BACKGROUND

In the resource recovery and fluid sequestration industries anchors are very common. Each is configured for the particular purpose to which it is put but will have the overall effect of anchoring a tool in place. Sometimes anchors are meant to be retrievable or movable within the borehole. While such systems work admirably, the art is always receptive to additional technologies that improve operation.

SUMMARY

An embodiment of a slip subsystem, including a slip having a first set of wickers angled in a first direction and a second set of wickers angled in a second direction opposite the first direction, an engager disposed adjacent the slip and movable to selectively engage the first set of wickers or the second set of wickers, and a biaser operably connected to the engager and configured to bias the engager into engagement with the first set of wickers or the second set of wickers.

An embodiment of an anchor including a housing having a slip ramp, a drive plate disposed within the housing, a power spring disposed between the housing and the drive plate to bias the drive plate, a slip subsystem operably connected with the housing.

An embodiment of a method for setting an anchor in a borehole, including driving a drive plate into a slip, forcing the slip to climb a housing ramp with which the slip is associated, engaging an activation block with the slip to prevent slip movement relative to the housing in an anti-setting direction.

An embodiment of a borehole system, including a borehole in a subsurface formation, a string in the borehole, and a slip subsystem disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
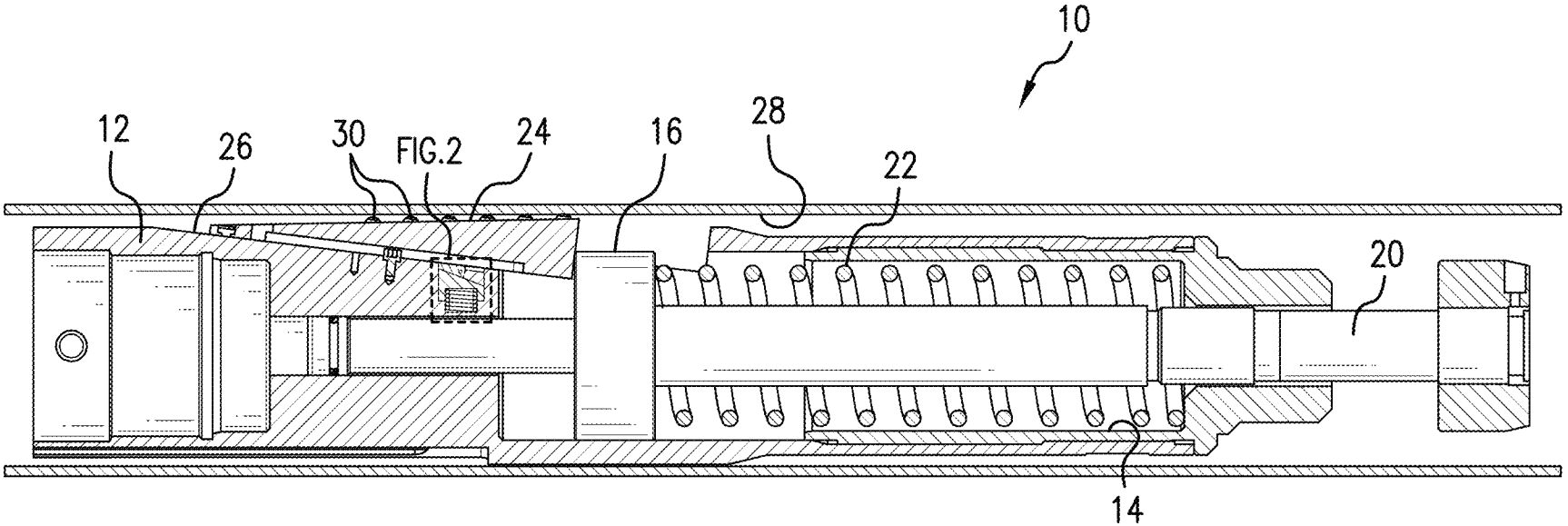
FIG. 1 is a sectional view of an anchor as disclosed herein.

Referring to FIG. 1, an anchor 10 is illustrated. The anchor comprises a housing 12 that defines an internal void 14 dimensioned and configured to accept a drive plate 16 disposed therein for reciprocal movement therein. The drive plate 16 is fixedly mounted to a mandrel 20 that extends beyond a longitudinal extent of the housing 12. Disposed between the housing 12 and the drive plate 16 is a power spring 22 that is configured to urge the drive plate 16 to the left of FIG. 1. In the illustration, the power spring 22 is a compression spring. It will be appreciated that a slip 24 is positioned to be contacted by the drive plate 16 and hence will be driven by the drive plate 16 up a ramp 26 of the housing 12. The slip 24 when driven up the ramp 26 will be displaced radially into contact with a borehole wall 28, whether that wall be an open hole or a casing. Slip 24 may include buttons 30 thereon to bite into wall 28 during setting. The anchor 10 further includes a subsystem referred to as slip subsystem 52 (se FIG. 2) that comprises the slip 24 and an engager 32.

Figure 2:
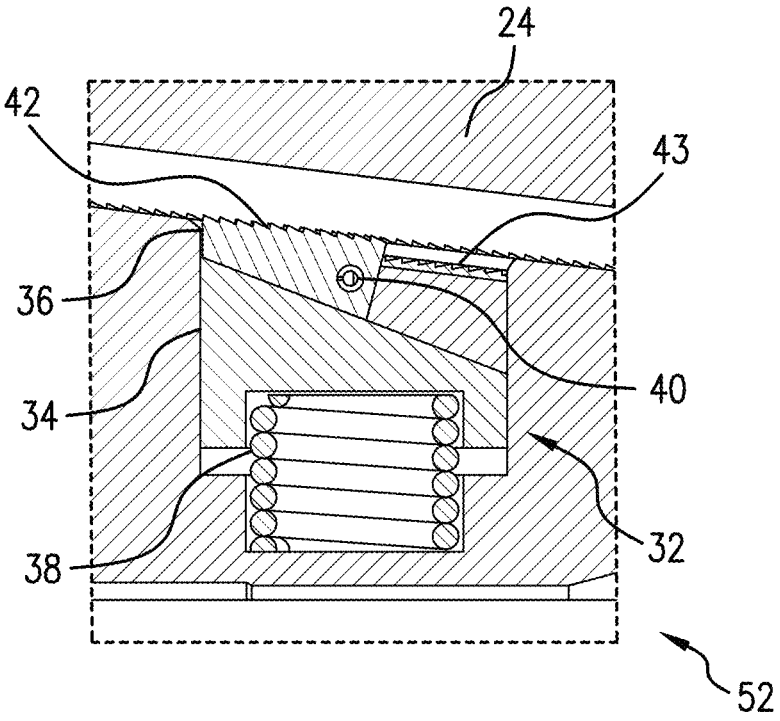
FIG. 2 is an enlarged view of an engager of FIG. 1.
Figure 3:
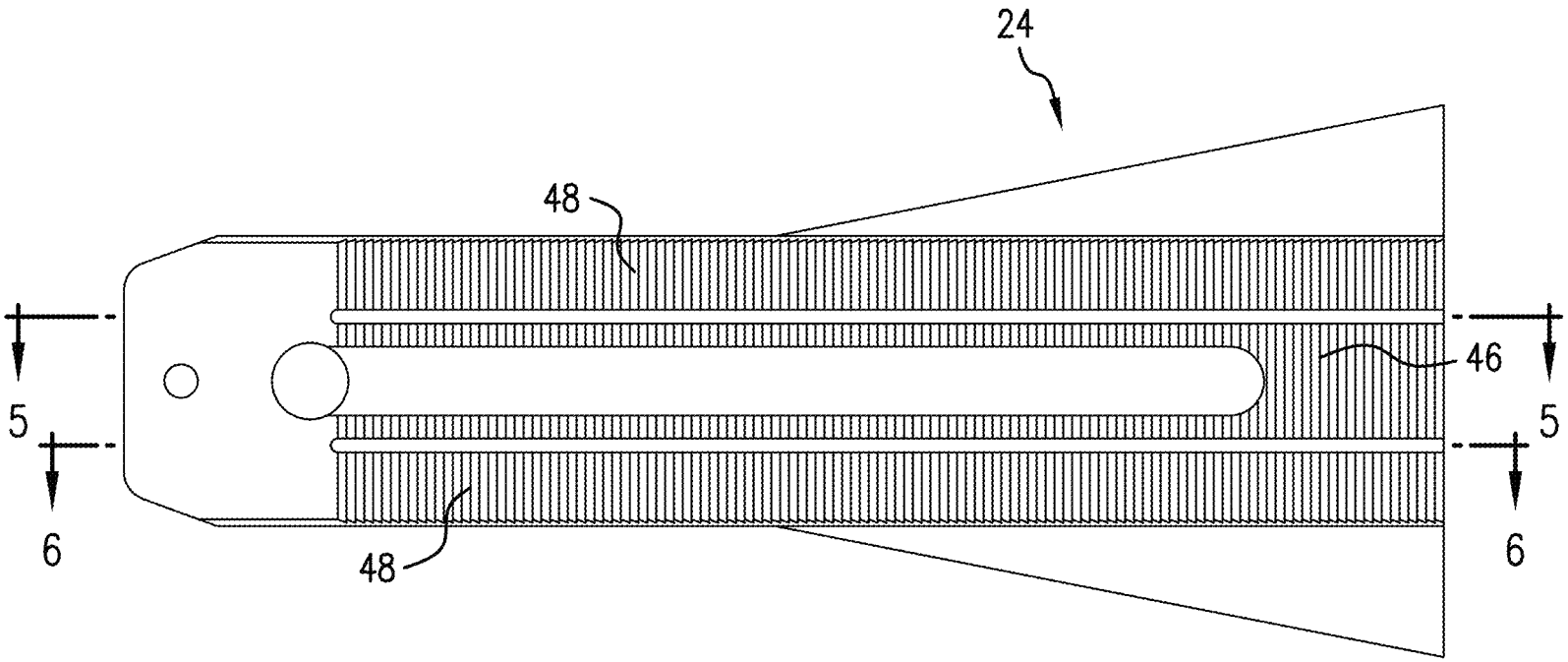
FIG. 3 is an inside surface view of a slip of FIG. 1.
Figure 7:
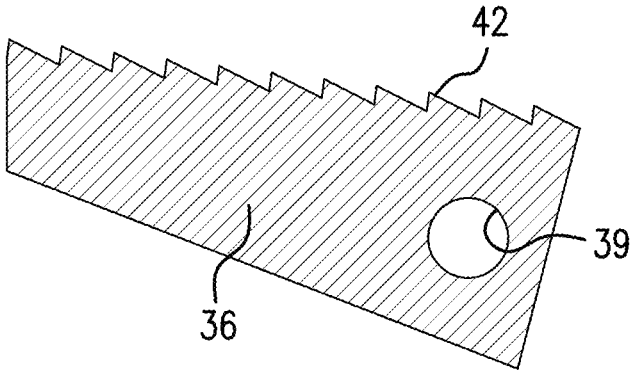
FIG. 7 is a view of an activation block as disclosed herein.
Figure 8:
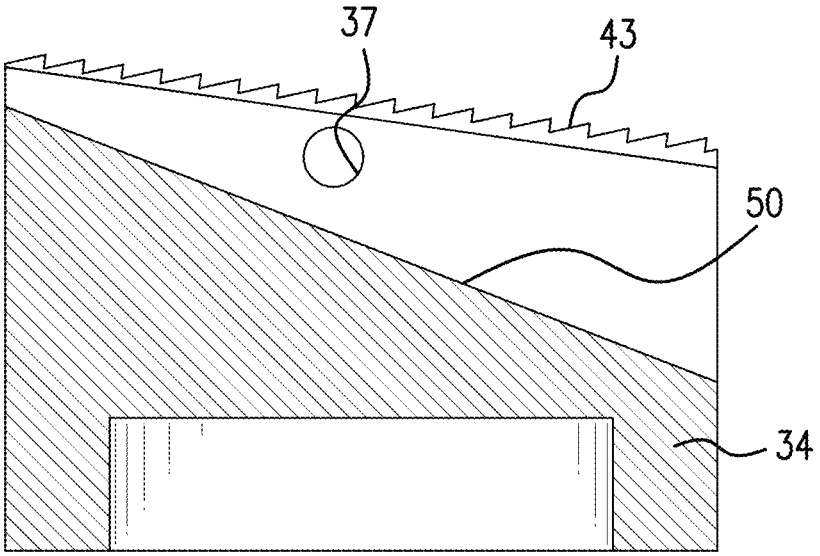
FIG. 8 is a view of a lock block as disclosed herein.
Figure 9:
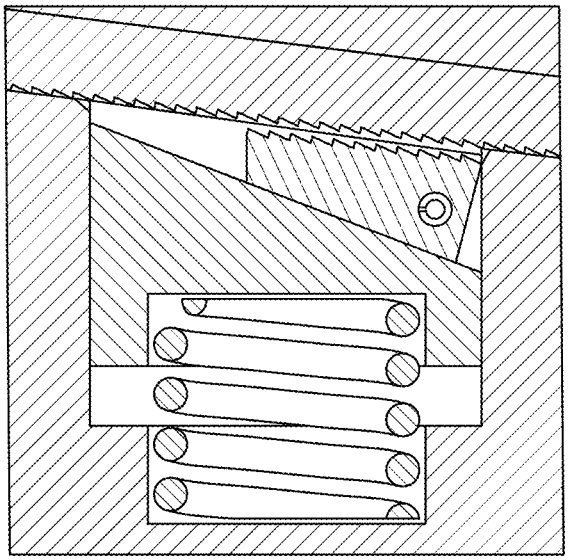
FIG. 9 is an enlarged view of the engager disclosed herein with the activation block sheared from the lock block.

Referring to FIGS. 1 and 2, the engager 32, is disposed in the housing 12 radially inwardly of the slip 24. The engager is configured to engage the slip 24 using wickers. The nature of the wickers on the slip 24 and engager 32 will be addressed hereunder after introduction of the components of the engager 32. Engager 32 includes a lock block 34, an activation block 36, and a biaser 38. The activation block 36 is movably mounted in the lock block 34 with a defeatable member such as a shear pin 40. Referring to FIGS. 7 and 8, it will be appreciated that the activation block 36 includes teeth 42 that angle in a first direction while lock block 34 has teeth 43 that angle in a second direction (illustrated as opposite). Biaser 38 works to engage the engager 32 with the slip 24 in each of the engager's operational positions (a setting and set position shown in FIG. 2 and an unsetting/unset position shown in FIG. 9). In FIGS. 7 and 8, openings 37 and 39 are easily visible. These openings are receptive of the pin 40 (and therefore aligned by the pin when in the position illustrated in FIG. 2).

Figure 4:
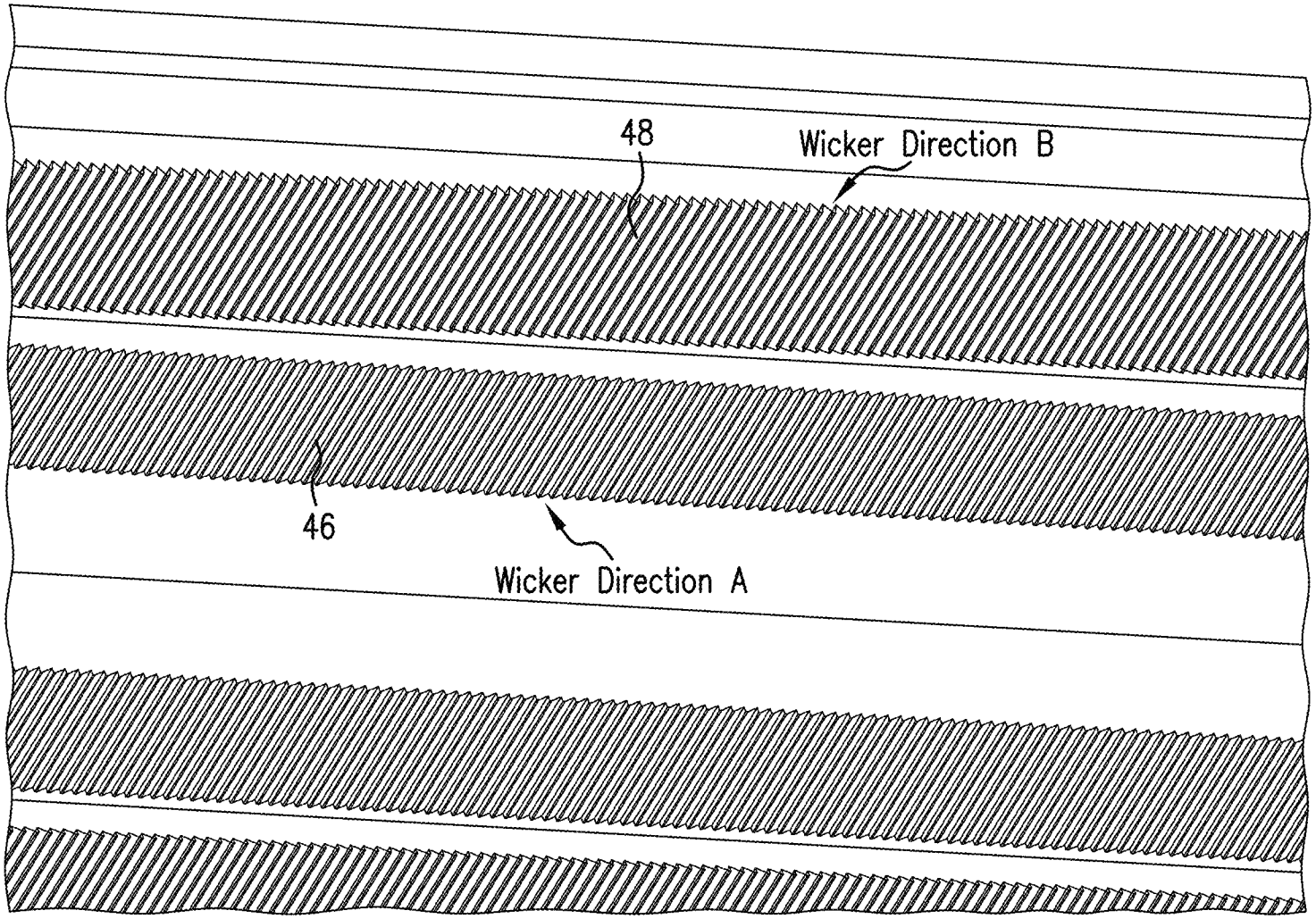
FIG. 4 is an enlarged view of the same surface illustrated in FIG. 3.
Figure 5:
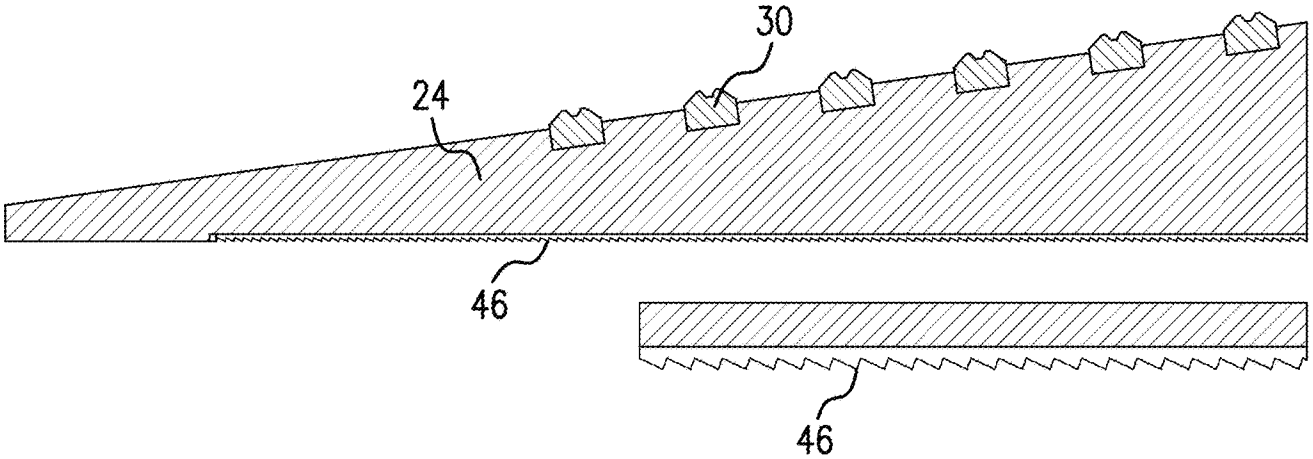
FIG. 5 is a sectional view of FIG. 3 taken along section line 5-5 in FIG. 3.
Figure 6:
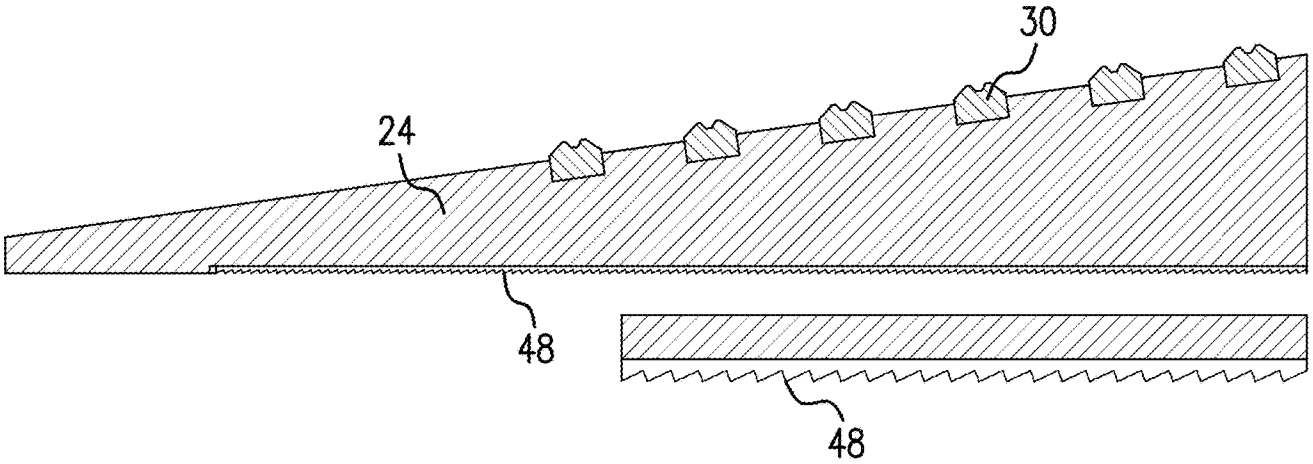
FIG. 6 is a sectional view of FIG. 3 taken along section line 6-6 in FIG. 3.

Referring back to FIG. 4-6. The slip 24 is illustrated in greater detail. Significantly, slip 24 includes a radially inwardly disposed surface 44 that is configured with wickers. There are a first set of wickers 46 angled in a first direction and a second set of wickers 48 angled in a second direction opposite the first direction. FIG. 4 shows the angular directions of the wickers using wicker direction A and wicker direction B. It will be appreciated that the activation block 36 engages the wickers with direction A such that ratcheting is possible with the slip 24 moving toward the left of FIG. 1 and holding is possible for slip 24 movement in the opposite (left of FIG. 1) direction. Accordingly, the drive plate 16 may push the slip 24 into engagement with the borehole wall 28 and then the slip 24 is held there by the activation block 36. This condition where the activation block 36 is engaged with the wickers of direction A can be seen in FIG. 2. The anchor 10 is set when the slip 24 is sufficiently biting into the wall 28 and the activation block 36 is preventing unloading movement of slip 24.

When unsetting is desired, an overpull on housing 12 is applied, which loads activation block 36 against lock block 34 through shear pin 40. Upon reaching a threshold load on pin 40, pin 40 shears thereby allowing the activation block 36 to move relative to lock block 34 to a position illustrated in FIG. 9. Because of a ramped recess 50 in lock block 34 (see FIG. 8), the activation block 36 will move to a portion of the lock block recess 50 that is taller than activation block 36. This ensures that activation block 36 and its wickers 42 are no longer able to engage slip 24 but also that lock block 34 wickers 43 can engage slip 24. The lock block wickers 43 engage the wickers 48 having direction B from FIG. 4. They thus may ratchet in a direction where the slip 24 is moving to the right of FIG. 1 but will lock if slip 24 moves to the left of FIG. 1. The arrangement ensures that the slip 24 will be shifted to a position relative to housing 12 that is sub gauge diameter of the housing 12 and thereafter will not score the borehole wall 28 while retrieving or moving the anchor 10.

Figure 10:
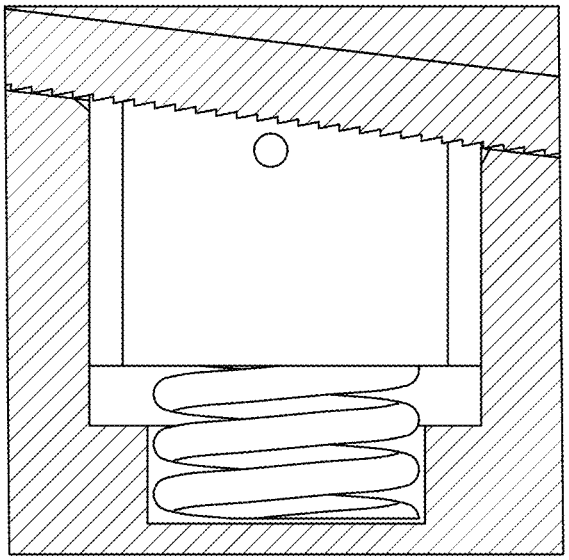
FIG. 10 is a view of the lock block engaged with the slip.
Figure 11:
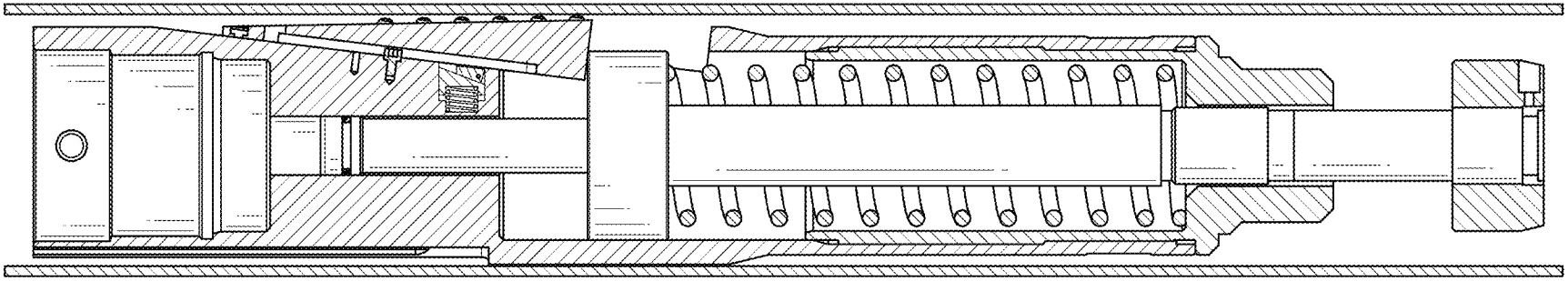
FIG. 11 is a sectional view of the anchor as illustrated in FIG. 1 but in a retrieval position.

While it is an intention and benefit that the anchor 10 may be retrieved to surface in this lock block engaged position where scoring is prevented (see FIGS. 9-11), it is also noted that the anchor 10 is configured to allow an operator to reset the anchor 10 at another location after the first set and retrieval (a contingency utility). If an action to reset the anchor 10 is taken, the function of retention of the slip for tripping will be lost but the value of being able to reset may be greater than the potential penalty of the slip scoring borehole wall 28 later in the life of the well. If a secondary setting operation is desired, the mandrel 20 is landed on a plug or other restriction in the borehole that will not allow the mandrel 20 to pass. Slack off weight against the mandrel 20 will load the drive plate 16 against the slip 24 and through the lock block 34. This will at a threshold load cause failure of the lock block 34 in shear and that will free the slip to be reset.

Figure 12:
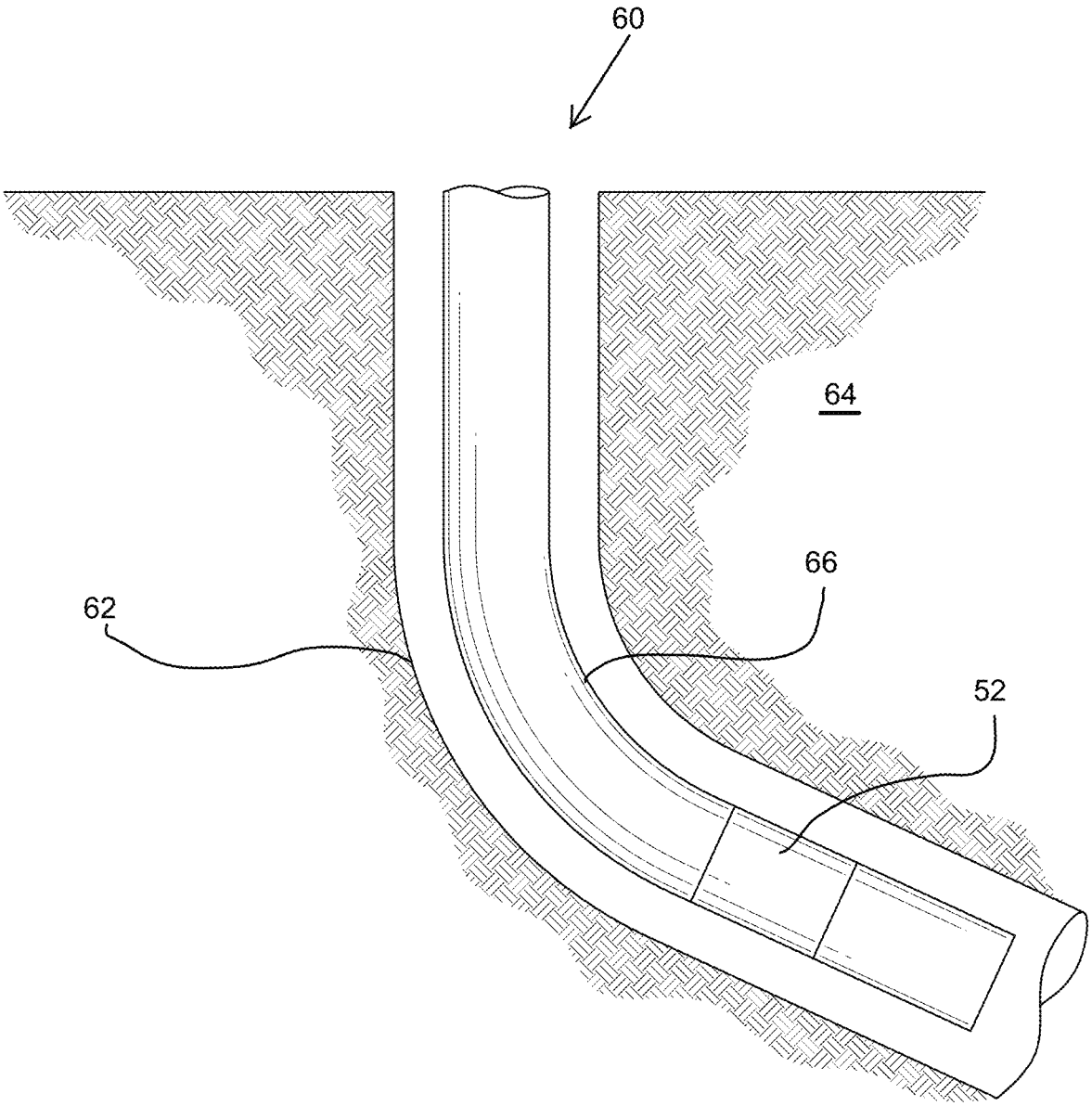
FIG. 12 is a view of a borehole system including xxx as disclosed herein.

Referring to FIG. 12, a borehole system 60 is illustrated. The system 60 comprises a borehole 62 in a subsurface formation 64. A string 66 is disposed within the borehole 62. A slip subsystem 52 as disclosed herein is disposed within or as a part of the string 66.

Set forth below are some embodiments of the foregoing disclosure:

Embodiment 1: A slip subsystem, including a slip having a first set of wickers angled in a first direction and a second set of wickers angled in a second direction opposite the first direction, an engager disposed adjacent the slip and movable to selectively engage the first set of wickers or the second set of wickers, and a biaser operably connected to the engager and configured to bias the engager into engagement with the first set of wickers or the second set of wickers.

Embodiment 2: The subsystem as in any prior embodiment, wherein the engager comprises a lock block.

Embodiment 3: The subsystem as in any prior embodiment, wherein the engager further comprises an activation block having a first condition that prevents engagement of the lock block with the slip and a second condition that permits the lock block to engage the slip.

Embodiment 4: The subsystem as in any prior embodiment, wherein the activation block is defeatably affixed to the lock block.

Embodiment 5: The subsystem as in any prior embodiment, wherein the activation block is shear pinned to the lock block.

Embodiment 6: The subsystem as in any prior embodiment, wherein the activation block includes teeth angled in a first direction.

Embodiment 7: The subsystem as in any prior embodiment, wherein the lock block includes teeth angled in a second direction.

Embodiment 8: The subsystem as in any prior embodiment, wherein the lock block includes a ramped recess therein.

Embodiment 9: The subsystem as in any prior embodiment, wherein the recess is receptive to an activation block.

Embodiment 10: An anchor including a housing having a slip ramp, a drive plate disposed within the housing, a power spring disposed between the housing and the drive plate to bias the drive plate, a slip subsystem as in any prior embodiment, operably connected with the housing.

Embodiment 11: The anchor as in any prior embodiment, wherein the drive plate is fixedly mounted to a mandrel that extends beyond the housing.

Embodiment 12: A method for setting an anchor in a borehole, including driving a drive plate into a slip, forcing the slip to climb a housing ramp with which the slip is associated, engaging an activation block with the slip to prevent slip movement relative to the housing in an anti-setting direction.

Embodiment 13: The method as in any prior embodiment, wherein the engaging the activation block includes urging the activation block into the slip via a biaser.

Embodiment 14: The method as in any prior embodiment, further including preventing engagement of a lock block with the slip by the activation block.

Embodiment 15: The method as in any prior embodiment, further including overpulling the anchor, releasing the activation block, and engaging a lock block with the slip.

Embodiment 16: The method as in any prior embodiment, wherein the releasing is shearing.

Embodiment 17: The method as in any prior embodiment, wherein the engaging the lock block includes retaining the slip at a sub gauge dimension of the anchor.

Embodiment 18: The method as in any prior embodiment, wherein the method further includes landing the anchor on a borehole restriction, loading the drive plate, shearing the lock block, and resetting the anchor.

Embodiment 19: A borehole system, including a borehole in a subsurface formation, a string in the borehole, and a slip subsystem as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A slip subsystem, comprising:

a slip having a first set of wickers angled in a first direction and a second set of wickers angled in a second direction opposite the first direction;

an engager disposed adjacent the slip and movable to selectively engage the first set of wickers or the second set of wickers, the engager comprising a lock block and an activation block having a first condition that prevents engagement of the lock block with the slip and a second condition that permits the lock block to engage the slip; and a biaser operably connected to the engager and configured to bias the engager into engagement with the first set of wickers or the second set of wickers.

2. The subsystem as claimed in claim 1, wherein the activation block is defeatably affixed to the lock block.

3. The subsystem as claimed in claim 2, wherein the activation block is shear pinned to the lock block.

4. The subsystem as claimed in claim 1, wherein the activation block includes teeth angled in a first direction.

5. The subsystem as claimed in claim 4, wherein the lock block includes teeth angled in a second direction.

6. The subsystem as claimed in claim 1, wherein the lock block includes a ramped recess therein.

7. The subsystem as claimed in claim 6, wherein the recess is receptive to an activation block.

8. An anchor comprising:

a housing having a slip ramp;

a drive plate disposed within the housing;

a power spring disposed between the housing and the drive plate to bias the drive plate;

a slip subsystem as claimed in claim 1, operably connected with the housing.

9. The anchor as claimed in claim 8, wherein the drive plate is fixedly mounted to a mandrel that extends beyond the housing.

10. A borehole system, comprising:

a borehole in a subsurface formation;

a string in the borehole; and a slip subsystem as claimed in claim 1, disposed within or as a part of the string.

11. A method for setting an anchor in a borehole, comprising:

driving a drive plate into a slip;

forcing the slip to climb a housing ramp with which the slip is associated;

engaging an activation block with the slip to prevent slip movement relative to the housing ramp in an anti-setting direction, wherein the engaging the activation block includes urging the activation block into the slip via a biaser.

12. The method as claimed in claim 11, further including preventing engagement of a lock block with the slip by the activation block.

13. The method as claimed in claim 11, further including:

overpulling the anchor;

releasing the activation block; and engaging a lock block with the slip.

14. The method as claimed in claim 13, wherein the releasing is shearing.

15. The method as claimed in claim 13, wherein the engaging the lock block includes retaining the slip at a sub gauge dimension of the anchor.

16. The method as claimed in claim 15, wherein the method further includes:

landing the anchor on a borehole restriction;

loading the drive plate;

shearing the lock block; and resetting the anchor.

* * * * *